US005417927A

United States Patent [19]

Houston

[11] Patent Number: 5,417,927

[45] Date of Patent: May 23, 1995

[54] LOW NOX, LOW FUEL REGENERATIVE INCINERATOR SYSTEM

[76] Inventor: Reagan Houston, 252 Foxhunt La., Hendersonville, N.C. 28739

[21] Appl. No.: 215,328

[22] Filed: Mar. 21, 1994

[51] Int. Cl.[6] ..... F23G 7/06

[52] U.S. Cl. ..... 422/110; 422/171; 422/172; 422/178; 422/177; 422/109; 432/181; 432/182; 431/5

[58] Field of Search ..... 422/109–111, 422/114–115, 171–172, 177–178, 182, 173, 175; 110/233, 210; 431/5, 7, 215; 432/180–182; 165/4, 10

[56] References Cited

U.S. PATENT DOCUMENTS

| | | | |
|---|---|---|---|
| 3,870,474 | 3/1975 | Houston | 422/177 |
| 4,038,032 | 7/1977 | Brewer et al. | 110/212 |
| 4,087,923 | 5/1978 | Wilt, Jr. et al. | 431/5 |
| 4,101,632 | 7/1978 | Lamberti et al. | 431/5 |
| 4,147,502 | 4/1979 | Milton, Jr. | 432/72 |
| 5,129,332 | 7/1992 | Greco | 432/182 |
| 5,259,757 | 11/1993 | Plejdrup et al. | 432/181 |

*Primary Examiner*—Robert J. Warden
*Assistant Examiner*—Hien Tran
*Attorney, Agent, or Firm*—Charles L. Schwab

[57] ABSTRACT

A multiple bed regenerative incinerator is cycled at regular intervals by an automatic control which causes fuel gas to be added to the impure inlet air for a first part of each cycle interval and interrupts the flow of fuel gas to the impure air inlet during a last part of each cycle interval thereby improving the purging of fuel gas from the regenerator being fed the impure air. Fuel gas flow may be adjusted by the control in response to signals from a monitor sensing the lower explosive limit of the impure air/fuel gas mixture. The control may cause the fuel gas to be delivered to a burner in a combustion chamber interconnecting the hot ends of the regenerators during the last part of each cycle interval. High dilution of fuel limits fume temperature and NOx production.

11 Claims, 3 Drawing Sheets

LOW NOX, LOW FUEL REGENERATIVE INCINERATOR SYSTEM

TECHNICAL FIELD

This invention relates to a system for operating regenerative. incinerators in a manner resulting in low nitric oxides, NOx, in the cleaned air and in low fuel consumption.

BACKGROUND OF THE INVENTION

Although fume regenerator or thermal oxidizer systems for removing volatile organic compounds, VOC's, are highly developed and relatively efficient, it is desirable to further improve such systems as to fuel consumption and generation of nitric oxide. Present regenerators can achieve a 99% destruction efficiency, if the regenerator bed is effectively purged. Also, present regenerators can be as much as 95% thermally efficient and can be self-sustaining at 5% of the lower explosive limit, LEL. This means that if the incoming contaminated air contains enough fuel values, such as methane, CH4, or the like, to be 5% of the lower explosive limit, then as this fuel is burned in the regenerative incinerator, enough heat is generated to make the process self-sustaining. If the fuel is methane, for example, the lower explosive limit is 5.3%. 5% of 5.3% is 0.265% methane or 2650 parts per million (ppm) by volume.

A 95% efficiency is a good result, however, it is not always achieved. Usually the contaminated air contains less than 5% of the LEL and additional fuel is supplied to the burners in the hot zone (combustion zone) of the regenerative incinerator. Typically, natural gas and combustion air are added to the burners. However, the fuel and air are not preheated because preheating would increase the amount of NOx produced by the burners. If all the fuel and corresponding air is supplied to the burners without preheating, the thermal efficiency drops from 95% to 93%. This drop in efficiency represents substantial operating expense. For instance, in a typical regenerative incineration system processing 100,000 standard cubic feet per minute at 93% thermal efficiency, the fuel cost per year, with natural gas priced at $4 per 1000 cubic feet, is about $780,000. At 95% thermal efficiency, the annual cost for fuel is $557,136. Thus in this typical system the annual fuel savings is $222,864.

It is known to process contaminated air containing about 2650 ppm of methane or equilavent fuel. There is, however, a big disadvantage in processing heavily contaminated air, namely destruction efficiency is adversely affected. For instance, in a three bed regenerative incinerator, such as disclosed in my U.S. Pat. No. 3,870,474, one bed is processing impure air, a second bed is processing purified air from the furnace and a third bed is being purged of impure feed gas before being used for processing purified air. However, purging is not perfect. Incomplete purging allows some impure feed gas to remain in the regenerator bed of porous heat retaining material (typically fire brick), thus permitting this retained impure gas to mix with purified gas, which lowers the destruction efficiency.

A notable disadvantage of the use of burners in the combustion zone is that the products of combustion are hot enough (over 1800° F.) to generate NOx. Even the low NOx burners, available at extra cost, only cut:the NOx production in half, which is still an undesirable amount of NOx in the purified gas.

OBJECTS AND SUMMARY OF THE INVENTION

It is an object of the invention to provide a regenerative incinerator having a low NOx level in the output and which is thermally efficient.

It is a further object of the invention to provide improved purging of fuel gas from the regenerator of a regenerative incinerator.

This invention solves the problems inherent in using a highly contaminated fuel gas in a regenerative incinerator, while simultaneously achieving high thermal efficiency and essentially no NOx generation. When processing a feed gas having only a small amount of fuel value, I have found that the desired benefits can be obtained by adding fuel to the feed gas, but with interruption. Regenerators are cycled at predetermined intervals, typically every 30 to 90 seconds. To achieve the desired results of the invention, fuel gas is added to the feed gas (impure air) for the cycle interval except for the last 2 to 5 seconds. Stopping the addition of fuel gas to the feed gas prior to switching the regenerators allows several bed volumes of feed gas without fuel to flow through the feed regenerator before switching. This helps greatly in removing residual amounts of fuel trapped in the bed of heat retention material, which typically is somewhat porous. This invention is also advantageously used in a 2 bed regenerative incinerator as will be apparent from the following description of the drawings.

DETAILED DESCRIPTION OF THE DRAWINGS

Figure 1:
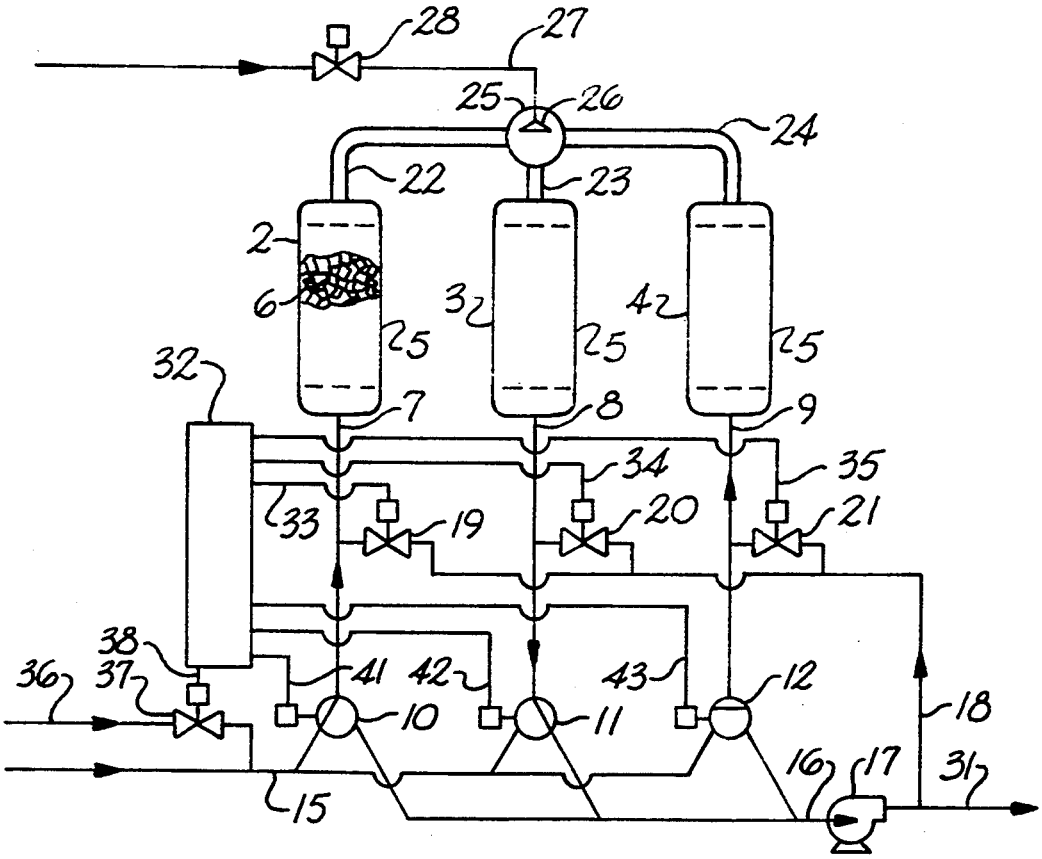
FIG. 1 shows a first embodiment of the invention in which fuel is added to the impure air being feed to a 3 bed regenerative incinerator.

Referring to FIG. 1, a regenerative incineration system is illustrated which includes three regenerators 2,3,4, each having a regenerator shell 5 filled substantially with a heat retaining material such as ceramic saddles or fire bricks 6. An inlet conduit 15 is provided for delivering impure air to the regenerators by way of parallel connected flow control valves 10, 11, 12 to the bottom or cool end of the shells 5 of the regenerators 2, 3, 4. Conduits 22, 23, 24 connect the upper or hot ends of the regenerators 2, 3, 4 to a combustion chamber 25 having a burner to which fuel in the form of fuel gas is supplied by a fuel line 27. A flow control valve 28 with open and closed positions is provided to selectively supply fuel to the burner 26 during start up of the system or as might be desired. A cleaned air outlet conduit 16 is connected in parallel to the valves 10, 11, 12 and to a discharge fan or air pump 17 which discharges cleaned air via a discharge conduit 31. A recycled air conduit 18 for supplying purge air interconnects the discharge conduit 31 to the branch conduits 7, 8, 9 by way of electrically operated valves 19, 20, 21. The electrically operated actuators of the valves 19, 20, 21 are connected to an electronic control or programmable controller or controller 32 by electric lines 33, 34, 35. The programable control 32, which includes a timing mechanism, is connected to the electrically operated actuators of the flow control valves 10, 11, 12 by electric lines 41, 42, 43. By line 38 the control 32 is electrically connected to the electrically operated actuator of a flow control valve 37 in a fuel gas supply conduit 36 by which fuel gas is selectively added to the impure air in input conduit 15.

The cyclic operation of the three regenerator system shown in FIG. 1 is substantially described in my U.S. Pat. No. 3,870,474. As illustrated in FIG. 1, the flow control valve 10 is in its impure air delivery position in which impure air inlet conduit 15 is connected to the regenerator 2 via conduit 7, the flow control valve 11 is in its cleaned air discharge position connecting the regenerator 3 to conduit 16 via branch conduit 8 and flow control valve 12 is in an off position in which position there is no flow through the valve. In the embodiment of the invention illustrated in FIG. 1, the electronic control 32 sequentially switches the flow through the regenerators 2, 3, 4 by cyclic operation of the valves 10, 11, 12, 19, 20, 21 at predetermined timed intervals. At start up of the system fuel valve 28 is opened to supply fuel to the burner 26, which may be equipped with a pilot light, not shown, or Which may be lit manually. After the desired operating temperature is reached (approximately 1200° F. to 1500° F. depending on the combustion temperature of the mixture of fuel gas and impure air being feed to the system), the fuel valve 28 is closed and fuel gas is added to the impure air by the control 32 operating the fuel valve 37. In order to help purge fuel gas from the feed regenerator, the control 32 automatically closes the valve 37 to stop the flow of fuel gas to the impure air inlet conduit 15 during the last part of each cycle interval. The regenerators may be cycled every 30 to 90 seconds, for instance. In order to reduce fuel contamination in the preheating or feed regenerator, I stop the flow of fuel gas to the impure air inlet conduit about 2 to 5 seconds before cycling. This lowers the fuel value of the feed from around 2650 ppm to a considerably lower value. As the impure air without fuel gas flows through the pipes, valves and bed of the regenerator, the contamination caused by the just previous flow of impure air and fuel gas is purged from such pipes, valves and bed. The thermal efficiency remains high because the fuel gas is preheated 80 to 99% of the time that it is expected to produce an overall 95% thermal efficiency. The destruction efficiency is as high as possible since the impure air in the feed regenerator has little impurity at the time of regenerator switch-over. Essentially no NOx is produced since there is no local heating to temperatures above 1700° F. Little, if any, NOx is formed at 1700° F. and below. Since fuel gas is added to the cool impure air, there is good mixing well below the temperature at which combustion takes place. Ignition temperatures range from 1170° F. for methane to 900° F. for propane down to about 446° F. for octane.

Figure 2:
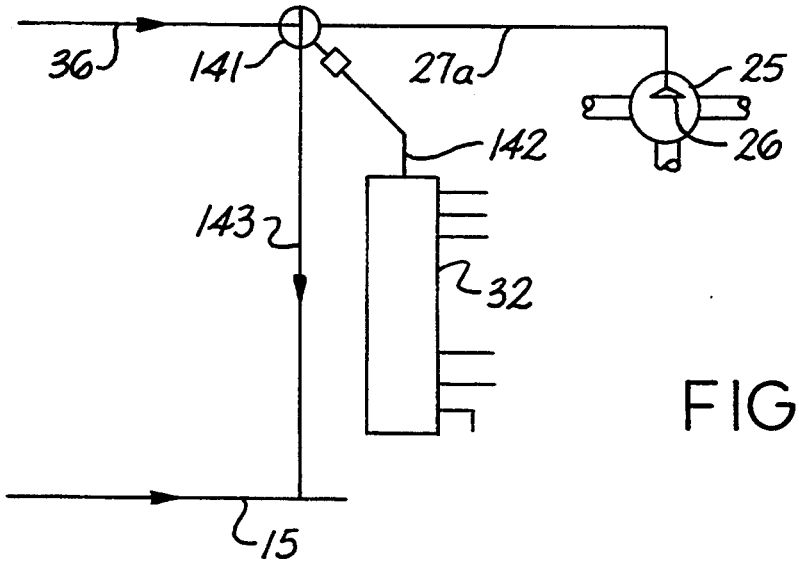
FIG. 2 shows a modification of the system shown in FIG. 1 in which a fuel control valve controls fuel flow to the impure input air and to the combustion chamber burner.

In the embodiment of the invention shown in FIG. 2, switching or valve means have been added to permit the fuel gas to be switched to the combustion chamber burner during the last part of each cycle interval. The controller 32 operates a flow control fuel valve 141 through an electrical line 142 interconnecting the controller to an electrically powered actuator component of the valve 141. In the valve position illustrated, fuel gas flows to the impure air inlet conduit 15 via fuel line 143. At a point in time when 80% to 99% of the cycle interval has transpired, the control 32 causes the valve 141 to rotate 90° clockwise, thereby blocking flow of fuel gas to the impure air input conduit 15 and connecting the fuel gas supply line 36 with the gas feeder line **27*a* leading to the burner 26 in the combustion chamber 25. At the end of the cycle interval, as determined by the timer component of the control, the control automatically switches the valve 141 to the position in which it is illustrated in FIG. 2, in which fuel gas is supplied to the impure air being fed to the regenerator next serving as the input regenerator, but is not supplied to the burner 26. The switching of fuel gas from delivery to the impure air conduit 15 to the burner 26 during the last part of each cycle interval, rather than simply stopping the flow to conduit 15 during such last part, avoids pressure or flow surges in the fuel gas being delivered via line 36**. The benefit of avoiding such surges must be weighed against a slight decrease in thermal efficiency and a slight increase in NOx generated.

Figure 3:
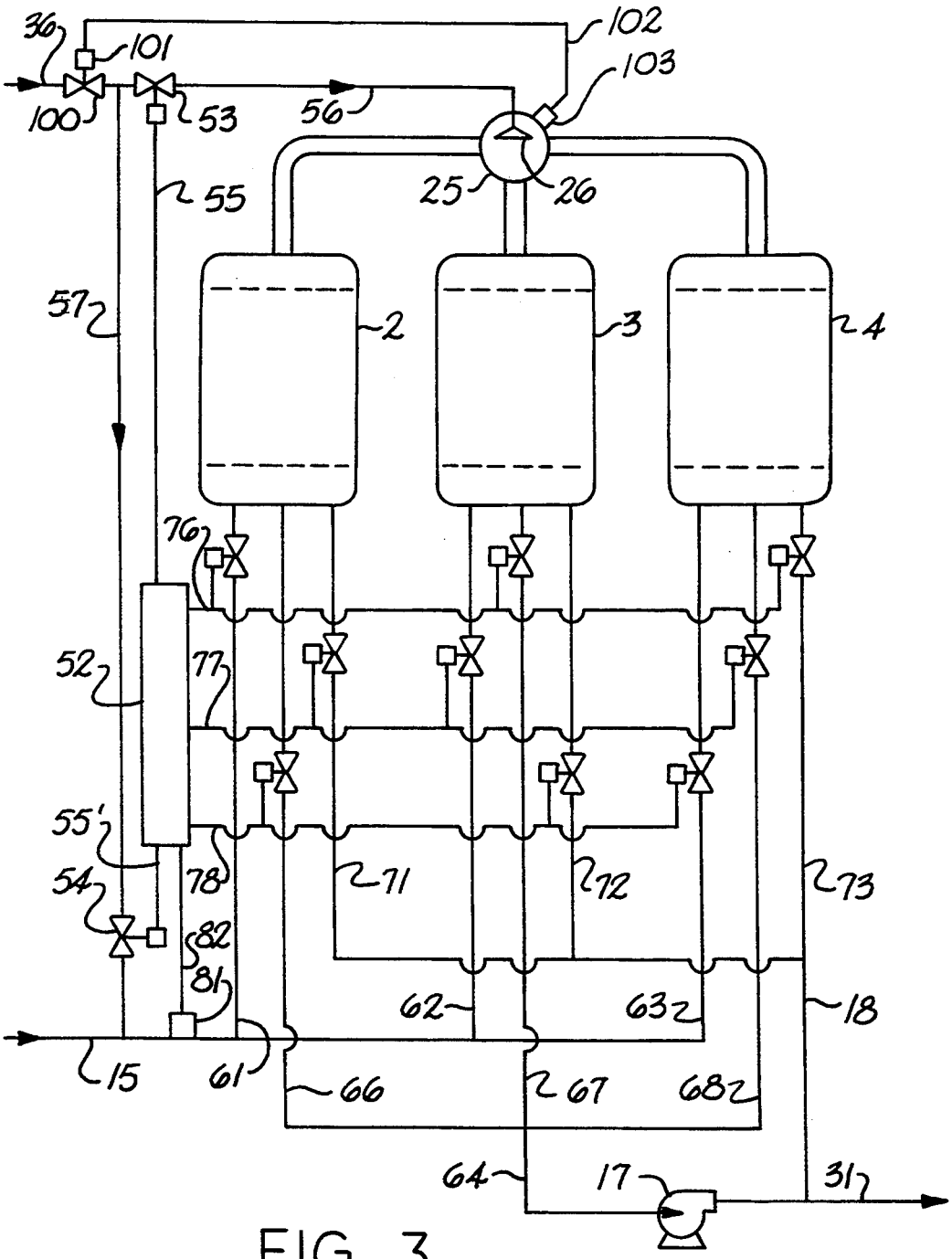
FIG. 3 is a further modification of the system of FIG. 1 wherein the controller operates two valves controlling flow of fuel to the combustion chamber burner and the impure air input and the controller operates 9 valves to effect cycling of the regenerators.

In the regenerative incinerator system illustrated in FIG. 3, the control 52 is electrically connected by the electric lines 55, 55' to the electrically powered actuators of flow control valves 54,53 in fuel gas lines 57,56 connecting tile impure air conduit 15 and the burner 26, respectively, with the feed gas line 36. An electrically operated variable flow valve 100 has an electric actuator 101 which responds to the signal via line 102 from a temperature sensor 103 at the combustion chamber 25. The valve 100, in response to signals from the temperature sensor 103, automatically adjusts the flow of fuel gas to the regenerative incinerator by way of fuel gas line 36 and thereby it is operative to maintain a combustion chamber temperature below 1800° F. By keeping the combustion chamber temperature below 1800° F., high temperature formation of NOx is prevented. The impure air conduit 15 is connected to the cool ends of the regenerators 2, 3, 4 by branch conduits 61, 62, 63. An outlet conduit 64 to the cleaned air discharge pump 17 is connected to the cool ends of the regenerators 2, 3, 4 by branch conduits 66, 67, 68. A purging air conduit 18, which is connected to the cleaned air discharge conduit 31 extending from the pump 17, is connected to the cool ends of the regenerators 2, 3, 4 by branch conduits 71, 72, 73. An electrically operated shut off valve is placed in each of the branch conduits 61, 62, 63, 66, 67, 68, 71, 72, 73 and the shut off valves are connected to the control 52 by electric lines constituting circuits 76, 77, 78. By this arrangement of valves and circuits the control 52 operates the shut off valves to provide the desired cycling of the regenerators. The control 52, which is programable and includes a timer, is operative to operate the shut off valves at predetermined intervals to cycle the flow of impure air, purge air and cleaned air through the regenerators 2, 3, 4, by sequentially energizing the circuits 76, 77, 78. The control 52 also performs another important function. The control 52 opens the fuel gas valve 54 to supply fuel gas to time impure air conduit 15 during a first part of the cycle interval of the regenerators and closes the valve 54 during the last 1 to 19% of the cycle interval. In some operations it may be desirable to supply fuel gas to the burner during the last part of each cycle interval. For that purpose the control 52 is programable to open valve 53 when the valve 54 is closed during the last 1 to 19% of the cycle interval.

A lower explosive limit monitor 81 is connected to the impure air conduit 15 and transmits electric signals to the control 52 via line 82. Upon receipt of a signal indicative of the LEL of the impure air and fuel gas mixture being above a safe limit such as 20% of the LEL, the control will automatically shut off all fuel gas flow to the system by closing the valves 53 and 54.

Figure 4:
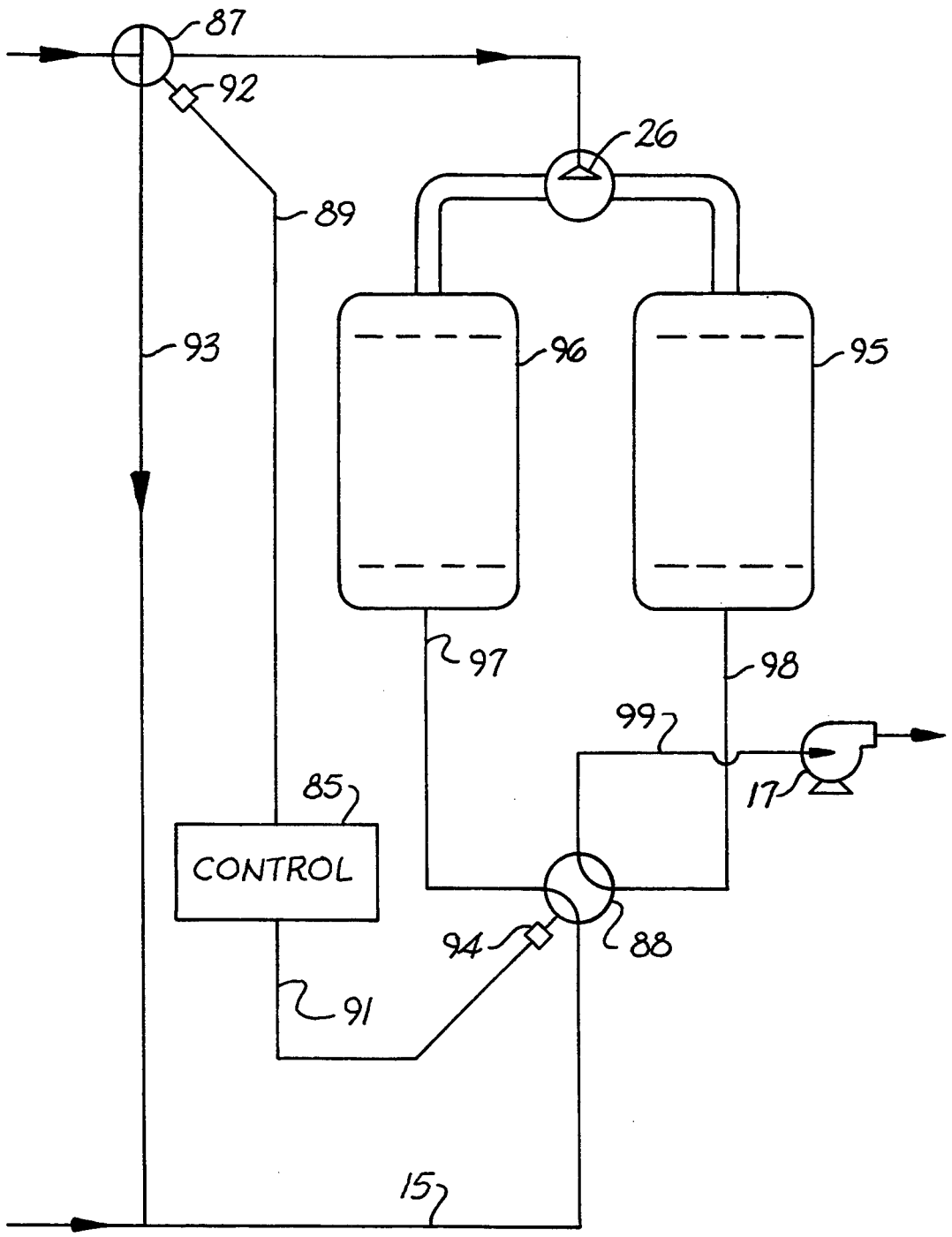
FIG. 4 shows the invention incorporated in a two bed regenerative incinerator system.

In FIG. 4 a two bed regenerative incinerator is illustrated in which a control 85 is electrically connected in controlling relation to directional or flow control valves 87, 88 by leads 89, 91. As illustrated, the valve 87 has been adjusted by its electrically operated actuator 92 to a position in which it directs fuel gas to the impure air conduit 15 via fuel line 93 and the flow control valve 88 has been adjusted by its electrically operated actuator 94 to a position in which the input mixture is directed to a regenerator 96 via branch conduit 97 and cleaned air from the regenerator 95 flows to the discharge pump 17 via branch conduit 98 and cleaned air conduit 99. The control 85 is operative to cycle the regenerators at regular intervals. The control 85 also positions the valve 87 in its shown position of adjustment during the first part of each cycle interval and is operative to rotate the valve 87 through an angle of 90 degrees clockwise to shift the fuel gas flow to the burner 26 during the last 1 to 19% of the cycle interval. Thus during the last part of each interval the impure air without added fuel gas acts to purge residual amounts of fuel gas from the bed of the feed regenerator and fuel gas flowing to the burner during the last part of the interval insures combustion to the end of the cycle. When flow is reversed in the regenerators by the control 85 rotating the valve 88 through 90 degrees, very little fuel gas will remain in regenerator 96, thus reducing contamination of the cleaned air.

In the hereinbefore described embodiments of the invention, the required fuel is completely mixed with the incoming impure air. As the mixture of fuel and impure air is heated to a combustion ignition temperature (600° to 1100° F., depending on impurities) by the regenerator, the gas starts burning. Since fuel plus volatile compounds are dilute (approximately 5% of the LEL), the flame temperature is below 1800° F. and essentially no NOx is generated during the first part of the cycle interval.

The embodiments of the invention herein described provide regenerative incineration with negligible NOx generation and with low fuel requirements. Those familiar with the technology may conceive other versions within the scope of this invention as defined by the appended claims.

I claim:

1. A regenerative incinerator system for purifying impure air, comprising:

first and second regenerator chambers each having a bed of heat retaining material and each having opposite first and second ends, a furnace chamber interconnecting said first ends of said regenerator chambers allowing air to pass from one regenerator chamber to another, inlet conduit means for conveying impure air to said second ends of said regenerator chambers, outlet conduit means for conveying cleaned air from said second ends of said regenerator chambers, valve means operatively associated with said inlet and outlet conduit means, said valve means being selectively positionable in a first position of adjustment in which said inlet conduit means is connected in impure air delivery relation to said second end of said regenerator chamber and said second end of said second regenerator chamber is connected in cleaned air delivery relation to said outlet conduit means and a second position of adjustment in which said inlet conduit means is connected in impure air delivery relation to said second end of said second regenerator chamber and said second end of said first regenerator chamber is connected in cleaned air delivery relation to said outlet conduit means, a supply of fuel gas, means connecting said supply of fuel gas to said furnace chamber including a furnace fuel supply valve having open and closed positions of adjustment, means connecting said supply of fuel gas to said inlet conduit means upstream of said valve means including a fuel gas flow control valve having one position of adjustment in which said supply of fuel gas is connected in delivery relation to said inlet conduit means and another position of adjustment in which fuel gas is prevented from delivery to said inlet conduit means and an electronic control operative to automatically adjust said valve means at predetermined time intervals between said first and second positions of adjustment whereby each regenerator chamber is alternately used as a feed chamber and an outlet chamber, said control automatically adjusting said fuel gas flow control valve to said one position of adjustment during a first part of each of said time intervals allowing fuel gas to flow to said inlet conduit means and adjusting said fuel gas flow control valve to said another position of adjustment during a last part of each of said time intervals to prevent flow of fuel gas to said inlet conduit means during said last part of each of said time intervals.

2. The system of claim 1 wherein said first part of each of said time intervals is 80% to 99% of each of time intervals.

3. The system of claim 1 and wherein said electronic control automatically adjusts said furnace fuel supply valve to said open position during the last part of each of said time intervals whereby fuel gas is delivered to said furnace chamber during said last part each of said time intervals.

4. A multiple bed regenerative incinerator system for purifying impure air, comprising:

a plurality of regenerators each having opposite first and second ends and a bed of heat absorbing material, a furnace chamber interconnecting said first ends of said regenerators allowing air to pass from one regenerator to another, an impure air inlet, a cleaned air outlet, conduit means connecting said second ends of said regenerators to said impure air inlet and to said cleaned air outlet, flow directing valve means in said conduit means having first and second positions of adjustment in which impure air is directed through said regenerators first in one direction and then in a reverse direction to purify the impure air and transfer heat from said absorbing material to the impure air and vice versa, a source of fuel gas, means for connecting said source of fuel gas to said furnace chamber including a furnace fuel supply valve having open and closed positions of adjustment, means connecting said source of fuel gas to said impure air inlet for selectively adding fuel gas to said impure air inlet including a fuel gas valve having open and closed positions of adjustment for controlling the flow of fuel gas to said impure air inlet and automatic electronic control means connected in controlling relation to said flow directing valve means and to said fuel gas valve, said automatic electronic control means operating to control said flow directing valve means to direct impure air through said regenerators for predetermined time intervals first in said one direction and then in said reverse direction, said electronic control means moving said fuel gas valve to said open position to admit fuel gas to said impure air inlet during a first part of each of said time intervals and moving said fuel gas valve to said closed position to stop flow of fuel gas to said impure air inlet during a last part of each of said time intervals.

5. The system of claim 4 wherein said last part of each of said time intervals is 1% to 19% of each of said time intervals.

6. The system of claim 4 and wherein said electronic control means automatically adjusts said furnace fuel supply vale to said open position during the last part of each of said time intervals whereby fuel gas is delivered to said furnace chamber during said last part of each of said time intervals.

7. A regenerative incinerator system comprising:

opposite first, second and third regenerators each having first and second ends and a bed of heat absorbing material, a furnace chamber connected to said first ends of said regenerators allowing air to pass from one regenerator to another, a source of fuel gas including a fuel line connected to said furnace chamber, a flow control valve in said fuel line having open and closed positions of adjustment, an impure air inlet, a cleaned air outlet, conduit means interconnecting said impure air inlet, said second ends of said regenerators and said cleaned air outlet, flow directing means located in aid conduit means for permitting said regenerators to be sequentially switched at predetermined time intervals so that each regenerator has an inlet period, a purge period and an outlet period, means connecting said source of fuel gas to said impure air inlet including a fuel gas valve having at least open and closed positions of adjustment and an automatic control switching said regenerators at said predetermined time intervals and adjusting said fuel gas valve to deliver fuel gas to said impure air inlet during a first part of each of said predetermined time intervals and to stop the flow of fuel gas to said impure air inlet during a last part of each of said predetermined time intervals.

8. The system of claim 7 wherein said automatic control adjusts said flow control valve to supply fuel gas to said furnace chamber during said last part of each of said predetermined time intervals.

9. The system of claim 7 wherein said last part of each of said predetermined time intervals is 1% to 19% of each of said predetermined time intervals.

10. The system of claim 7 and further comprising a LEL monitor connected to said impure air inlet downstream of the connection of said fuel gas supply to said impure air inlet, said monitor being connected in signal delivery relation to said automatic control, said automatic control being operative to adjust said fuel gas valve to the closed position of adjustment when said monitor delivers a signal to said automatic control indicating said impure air contains at least 20% of the LEL of the impure air and fuel gas mixture.

11. The system of claim 7 wherein said flow control valve is a variable flow valve controlling the flow of fuel gas to said furnace chamber and further comprising an electrically operated actuator for operating said variable flow valve and a temperature sensor at said furnace chamber connected in signal delivery relation to said variable flow valve, said actuator adjusting said variable flow valve in response to said signal from said sensor whereby the temperature in said furnace chamber does not exceed 1800° F.

* * * * *

UNITED STATES PATENT AND TRADEMARK OFFICE

CERTIFICATE OF CORRECTION

PATENT NO. : 5,417,927

DATED : May 23, 1995

INVENTOR(S) : Reagan Houston

It is certified that error appears in the above-identified patent and that said Letters Patent is hereby corrected as shown below:

Column 6, line 8, after "said" (first occurrence) insert --- first ---:

Column 6, line 46, after "of" (third occurrence) insert —said—

Column 6, line 52, after "part" insert --- of --- ;

Column 7, line 36 (3rd line of claim 6) cancel "vale" and substitute

--- valve --- ;

Column 8, line 8, cancel "aid" and substitute --- said --- ;

Signed and Sealed this

Twenty-ninth Day of August, 1995

*Attest:*

*Attesting Officer*

BRUCE LEHMAN

*Commissioner of Patents and Trademarks*